US007352381B2

(12) United States Patent
Nakanishi

(10) Patent No.: US 7,352,381 B2
(45) Date of Patent: Apr. 1, 2008

(54) THERMAL PRINT HEAD

(75) Inventor: Masatoshi Nakanishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/587,018

(22) PCT Filed: Jan. 24, 2005

(86) PCT No.: PCT/JP2005/000867

§ 371 (c)(1),
(2), (4) Date: Jul. 24, 2006

(87) PCT Pub. No.: WO2005/070683

PCT Pub. Date: Aug. 4, 2005

(65) Prior Publication Data

US 2007/0120941 A1 May 31, 2007

(30) Foreign Application Priority Data

Jan. 26, 2004 (JP) ..... 2004-016705

(51) Int. Cl.
*B41J 2/345* (2006.01)

(52) U.S. Cl. ..... 347/206

(58) Field of Classification Search ..... 347/200, 347/201, 206, 207
See application file for complete search history.

(56) References Cited

FOREIGN PATENT DOCUMENTS

| | | |
|---|---|---|
| JP | 63-179763 | 7/1988 |
| JP | 2-153754 | 6/1990 |
| JP | 5-69570 | 3/1993 |
| JP | 8-150750 | 6/1996 |
| JP | 8-300601 | 11/1996 |
| JP | 10-138543 | 5/1998 |
| JP | 2003-220726 | 8/2003 |

*Primary Examiner*—Huan Tran
(74) *Attorney, Agent, or Firm*—Hamre, Schumann, Mueller & Larson, P.C.

(57) ABSTRACT

A thermal print head (A1) has main heat producing resistor sections (31) formed on a substrate (1) and arranged in the main scan direction (X) at predetermined intervals; auxiliary heat producing resistor sections (32) provided with a predetermined gap in the auxiliary scan direction (Y) relative to the main heat producing resistor sections (31); first electrodes (43) for individually connecting in series, out of the main heat producing resistor sections (31) and the auxiliary heat producing resistor sections (32), at least main heat producing resistor sections (31) and auxiliary heat producing resistor sections (32) arranged in the auxiliary scan direction (Y); and second electrodes (41, 42) for conducting electricity to the series circuits composed of the main heat producing resistor sections (31) and the auxiliary heat producing resistor sections (32) connected in series by the first electrodes(43). The distance (D2) in the auxiliary scan direction (Y) between each main heat producing resistor section (31) and each auxiliary heat producing resistor section (32) is greater than the length (L1) in the auxiliary scan direction (Y) of each main heat producing resistor section (31).

7 Claims, 4 Drawing Sheets

THERMAL PRINT HEAD

TECHNICAL FIELD

The present invention relates to a thermal printhead for use in a thermal printer.

BACKGROUND ART

FIG. 7 shows an example of conventional thermal printhead (See Patent Document 1, for example).

The thermal printhead B is applicable to printing on thermal recording paper and printing on standard recording paper using an ink ribbon. The thermal printhead B performs printing on recording paper by repeating dot-printing operation in a primary scanning direction X (from left to right in FIG. 7) while transferring the recording paper in a secondary scanning direction Y (from below to above in FIG. 7).

Specifically, the thermal printhead B heats thermal recording paper dot by dot to directly perform printing on the recording paper or heats an ink ribbon dot by dot to transfer the ink of the ink ribbon to recording paper to perform printing on the recording paper. The thermal printhead has the function of so-called preheating in the printing process. Preheating is to preliminarily heat thermal recording paper or an ink ribbon by an auxiliary heat-producing resistor section 93 at a temperature which does not cause printing directly before heating the thermal recording paper or the ink ribbon by main heat-producing resistor section 92 for dot printing.

To perform printing on thermal recording paper or printing by heating an ink ribbon, the temperature of the thermal recording paper or the ink ribbon needs to be raised from room temperature to a temperature for printing. Therefore, when printing is to be performed while transferring the recording paper or the ink ribbon, the transfer speed of the thermal recording paper or the ink ribbon is limited to secure time for the temperature rise.

However, by performing preheating directly before the dot printing operation of the thermal recording paper or the ink ribbon, the temperature of the thermal recording paper or the ink ribbon can be raised in advance to a temperature lower than the temperature for printing. Therefore, by the preheating, the time taken for the temperature rise in the dot printing operation can be shortened, which makes it possible to increase the transfer speed of the thermal recording paper or the ink ribbon.

Since an ink ribbon is generally very thin, the rapid temperature rise of the ink ribbon over a wide area in the printing process may result in thermal expansion of the ink ribbon and hence the formation of wrinkles in the ink ribbon. However, by the preheating, the rapid temperature rise of the ink ribbon is prevented, whereby the formation of wrinkles in the ink ribbon is prevented.

The thermal printhead B includes a substrate 91 on which a plurality of main heat-producing resistor sections 92, a plurality of auxiliary heat-producing resistor sections 93 and electrodes 94-96 for energizing these sections are provided. Each of the main heat-producing resistor sections 92 is a heating element for performing the printing of one dot, whereas each of the auxiliary heat-producing resistor sections 93 is a heating element for preliminarily heating thermal recording paper or an ink ribbon in performing printing by heating the thermal recording paper or the ink ribbon by the main heat-producing resistor section 92.

The plurality of main heat-producing resistor sections 92 are arranged in a row in the primary scanning direction X at predetermined intervals, so are the auxiliary heat-producing resistor sections 93. Each of the auxiliary heat-producing resistor sections 93 is positioned upstream from each of the main heat-producing resistor sections 92 in the secondary scanning direction Y (upstream in the direction in which recording paper is transferred in the printing process) and connected in series to the main heat-producing resistor section 92 by the electrode 96.

The distance D4 between the main heat-producing resistor section 92 and the auxiliary heat-producing resistor section 93 is made shorter than the length L4 of the main heat-producing resistor section 92 in the secondary scanning direction Y. This is because, when the distance D4 is shorter than the length L4 of the main heat-producing resistor section 92, the preheating by the auxiliary heat-producing resistor section 93 works effectively even when the recording paper is transferred at high speed in the secondary scanning direction Y.

The width Wa of each of the auxiliary heat-producing resistor sections 93 is larger than the width Wb of each of the main heat-producing resistor sections 92. The main heat-producing resistor sections 92 and the auxiliary heat-producing resistor section 93 which are spaced in the secondary scanning direction Y are connected in series and heated by applying the same current. Therefore, by making the width Wa larger than the width Wb, the resistance of the main heat-producing resistor section 92 becomes higher than that of the auxiliary heat-producing resistor section 93 so that the amount of heat production of the main heat-producing resistor section 92 becomes larger than the amount of heat production of the auxiliary heat-producing resistor section 93.

Specifically, the resistance of a resistor section is directly proportional to the dimension (length) in the direction in which current flows (secondary scanning direction Y in FIG. 7) and inversely proportional to the dimension (width) in the direction (primary scanning direction X in FIG. 7) which is perpendicular to the current flow direction. Therefore, the resistance of the auxiliary heat-producing resistor section 93 is made lower than that of the main heat-producing resistor section 92 by making the width Wa of the auxiliary heat-producing resistor section 93 larger than the width Wb of the main heat-producing resistor section 92.

Patent Document 1: JP-A-H08-150750

In the conventional thermal printhead B, the distance D4 between the main heat-producing resistor section 92 and the auxiliary heat-producing resistor section 93 is small and made shorter than the length L4 of the main heat-producing resistor section 92 in the secondary scanning direction Y, which causes the following problems.

The main heat-producing resistor section 92 and the auxiliary heat-producing resistor section 93 which correspond to a dot to be printed are controlled to be energized and produce heat simultaneously. Therefore, the heat produced at the main heat-producing resistor section 92 is transmitted to the auxiliary heat-producing resistor section 93 through the electrode 96, which disadvantageously raises the temperature of the electrode 96 and influences the temperature of the auxiliary heat-producing resistor section 93.

Particularly, to print a line extending in parallel with the secondary scanning direction Y on a recording sheet, the same main heat-producing resistor section 92 and the relevant auxiliary heat-producing resistor section 93 are continuously energized for continuous heat production. In such a case, the heat production at the main heat-producing resistor section 92 and the auxiliary heat-producing resistor section 93 are continued, so that the heating temperature at the auxiliary heat-producing resistor section 93 becomes higher than the predetermined preheating temperature due to the influence of the heat production at the main heat-producing resistor section 92.

Moreover, even when the energization of the same heat-producing resistor section 92 and the auxiliary heat-producing resistor section 93 is not continuous, the main heat-producing resistor section 92 is not sufficiently cooled when the printing operation is repetitively performed with short intervals. Also in this case, the heating temperature of the main heat-producing resistor section 92 influences the heating temperature of the auxiliary heat-producing resistor section 93 to make the temperature higher than the predetermined preheating temperature.

Therefore, in the printing on thermal recording paper by using the conventional thermal printhead B, the heating temperature of the auxiliary heat-producing resistor section 93 or the temperature of the electrode 96 may exceed the intended temperature. In such a case, the thermal paper is heated by these elements and colored, which results in deterioration of the print quality.

With the conventional thermal printhead B, the above-described problem also occurs in the printing on regular recording paper which is performed by heating an ink ribbon and melting the ink for transferring to the recording paper. Specifically, the temperature of the auxiliary heat-producing section 93 or the electrode 96 rises and exceeds the predetermined temperature so that the ink of the ink ribbon is melt and transferred to the recording paper, which leads to the deterioration of the print quality.

In addition, since the conventional thermal printhead B has the preheating function, the formation of wrinkles in the ink ribbon can be lessened as compared with a thermal printhead which does not have preheating function. However, as noted before, the distance D between the main heat-producing resistor section 92 and the auxiliary heat-producing resistor section 93 is small in the conventional thermal printheadB. Therefore, when the ink ribbon and recording paper are transferred at high speed, the preheating of the ink ribbon by the auxiliary heat-producing resistor section 93 and the heating of the ink ribbon by the main heat-producing resistor section 92 for printing are performed substantially successively, so that the rapid temperature increase occurs in two stages. Therefore, the formation of wrinkles in the ink ribbon cannot be sufficiently prevented by the preheating.

DISCLOSURE OF THE INVENTION

The present invention is conceived under the above-described circumstances. It is, therefore, an object of the present invention to provide a thermal printhead which includes a main heat-producing resistor section for dot printing and an auxiliary heat-producing resistor section additionally provided for preheating and which is capable of enhancing the print quality.

According to the present invention, there is provided a thermal printhead comprising a plurality of main heat-producing resistor sections formed on a substrate and arranged at predetermined intervals in a primary scanning direction; a plurality of auxiliary heat-producing resistor sections each of which is spaced from a respective one of the main heat-producing resistor sections by a predetermined distance in a secondary scanning direction which is perpendicular to the primary scanning direction; a plurality of first electrodes each connecting, in series, at least one of the main heat-producing resistor sections and the corresponding auxiliary heat-producing resistor section which are arranged in the secondary scanning direction; and a plurality of second electrodes for energizing the series circuits of the main heat-producing resistor sections and the auxiliary heat-producing resistor sections connected in series by the first electrodes, printing being performed by heating a printing recording medium by the main heat-producing resistor sections while transferring the printing recording medium in the secondary scanning direction. The distance between each of the main heat-producing resistor sections and a corresponding one of the auxiliary heat-producing resistor sections in the secondary scanning direction is larger than the length of the main heat-producing resistor section in the secondary scanning direction.

Preferably, the distance between each of the main heat-producing resistor sections and a corresponding one of the auxiliary heat-producing resistor sections in the secondary scanning direction is not more than twice the length of the main heat-producing resistor section in the secondary scanning direction.

Preferably, each of the main heat-producing resistor sections and each of the auxiliary heat-producing resistor sections are generally equal to each other in width in the primary scanning direction.

Preferably, each of the auxiliary heat-producing resistor sections is smaller than each of the main heat-producing resistor sections in length in the secondary scanning direction.

Preferably, the plurality of main heat-producing resistor sections and the plurality of auxiliary heat-producing resistor sections are divided into a plurality of sets each including two main heat-producing resistor sections and two auxiliary heat-producing resistor sections arranged adjacent in the secondary scanning direction. The first electrode connects the two main heat-producing resistor sections and the two auxiliary heat-producing resistor sections in each of the sets in series.

Preferably, each of the auxiliary heat-producing resistor sections is positioned upstream from each of the main heat-producing resistor sections in the secondary scanning direction.

Preferably, the thermal printhead further comprises a glaze layer including a bulging portion and formed on the substrate. The bulging portion includes a top surface and an inclined surface which is positioned downstream from the top surface in the secondary scanning direction and which gradually reduces the height from the substrate while extending downstream in the secondary scanning direction.

Each of the main heat-producing resistor sections is provided on the inclined surface of the bulging portion, and each of the auxiliary heat-producing resistor sections is provided on the top surface or the inclined surface of the bulging portion at a position higher than each of the main heat-producing resistor sections.

Preferably, each of the auxiliary heat-producing resistor sections is positioned downstream from each of the main heat-producing resistor sections in the secondary scanning direction.

Preferably, the plurality of auxiliary heat-producing resistor sections include a first auxiliary heat-producing resistor section for preheating provided upstream from the main heat-producing resistor sections in the secondary scanning direction and a second auxiliary heat-producing resistor section for post-heating provided downstream from the main heat-producing resistor sections in the secondary scanning direction.

BEST MODE FOR CARRYING OUT THE INVENTION

Preferred embodiments of the present invention will be described below in detail with reference to the accompanying drawings.

Figure 1:
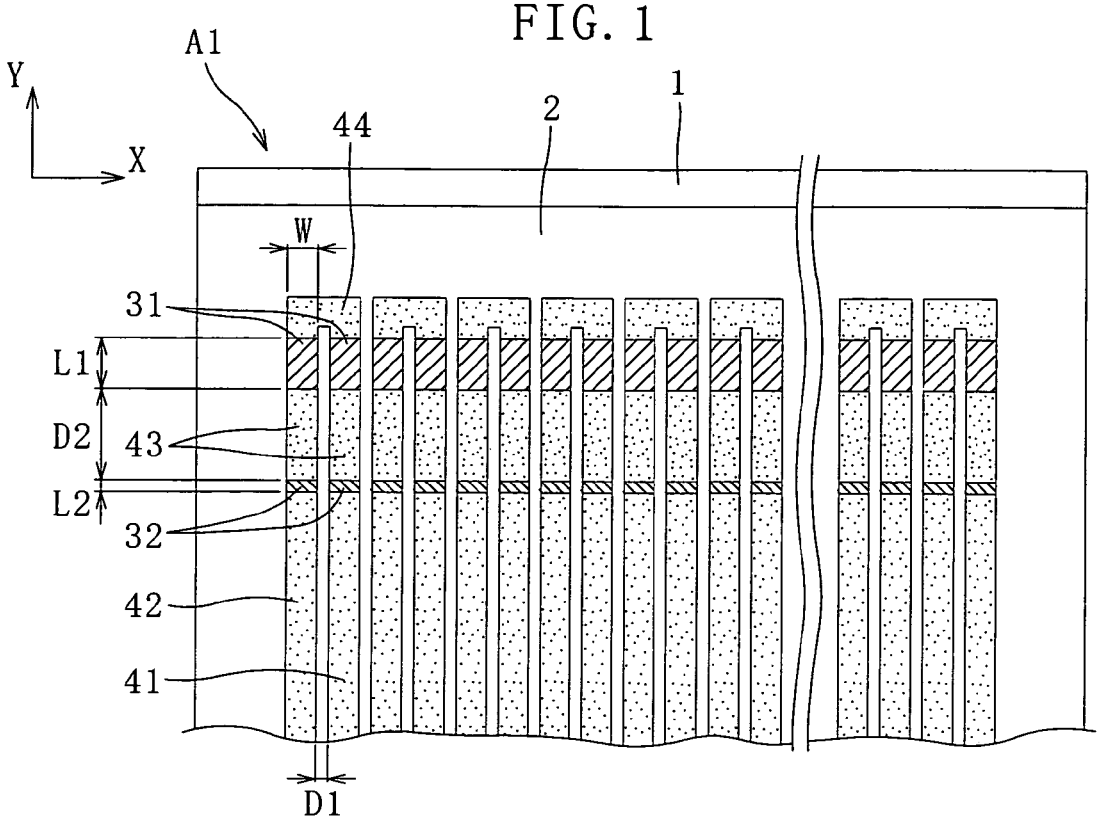
FIG. 1 is a plan view showing a principal portion of a thermal printhead according to a first embodiment of the present invention.
Figure 2:
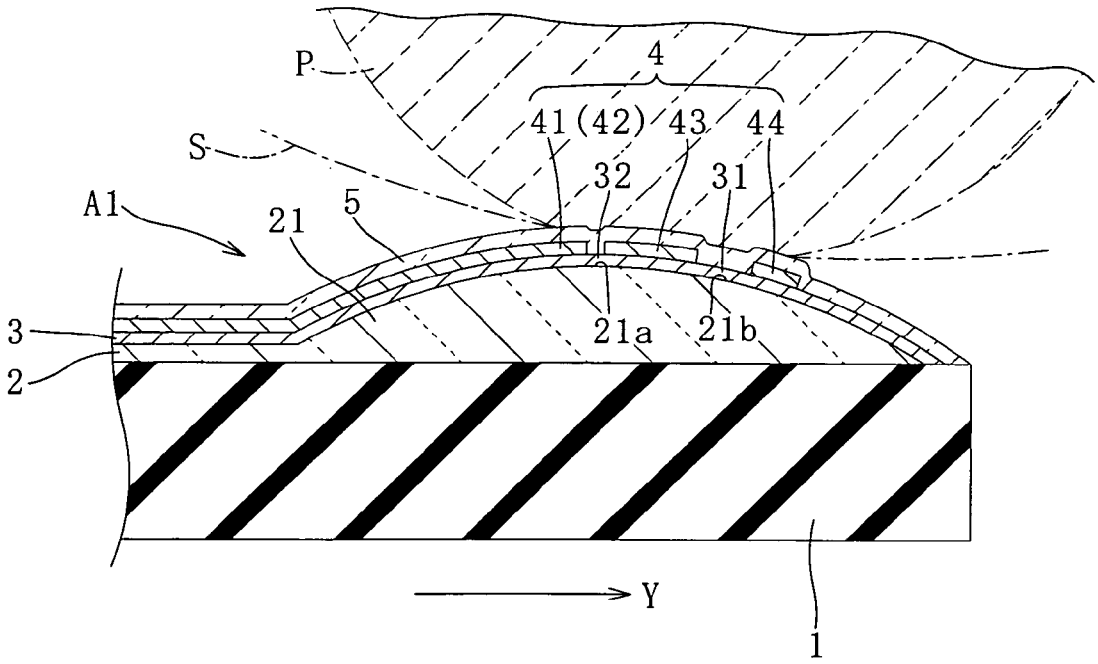
FIG. 2 is a sectional view of the principal portion of the thermal printhead shown in FIG. 1.

FIG. 1 is a plan view showing a principal portion of a thermal printhead according to a first embodiment of the present invention. FIG. 2 is a sectional view showing the principal portion of the thermal printhead in the process of performing printing on thermal recording paper. In FIG. 1, the protective layer 5 is omitted. The hatched portions indicate resistor layers 3, whereas the dotted portions indicate electrode layers 4.

The thermal printhead A1 according to the first embodiment is a thermal printhead having preheating function. The thermal printhead A1 is applicable to printing on thermal recording paper and printing on standard recording paper using an ink ribbon.

The thermal printhead A1 performs printing on recording paper by repeating dot-printing operation in a primary scanning direction X (from left to right in FIG. 1) while transferring the recording paper in a secondary scanning direction Y (from below to above in FIG. 1). Specifically, the print head performs printing by heating thermal recording paper dot by dot to directly print on the recording paper or by heating an ink ribbon dot by dot to transfer the ink of the ink ribbon to the recording paper.

The thermal printhead A1 includes a substrate 1, a glaze layer 2, a plurality of main heat-producing resistor sections 31, a plurality of auxiliary heat-producing resistor sections 32, a plurality of first through fourth electrodes 41-44, and a protective layer 5.

The substrate 1 is a flat plate having a rectangular configuration elongated in the primary scanning direction X and made of an insulating material such as aluminum ceramic material, for example. As shown in FIG. 2, the glaze layer 2, the heat-producing resistor layers 3, the electrode layers 4 and the protective layer 5 are laminated on the substrate 1 in the mentioned order.

The glaze layer 2 functions to ensure the pressure contact of the printing recording medium with the main heat-producing resistor sections 31 and provide the heat-producing resistor layers 3 with a heat retention property. Herein, the printing recording medium means the thermal recording paper in the case of printing on thermal recording paper and means the lamination of the ink ribbon and the recording paper in the case of printing on standard recording paper using an ink ribbon. The glaze layer 2 is formed by printing and burning glass paste and includes a bulging portion 21 which is bulged to have a generally arc outer surface at an end in the primary scanning direction Y.

The heat-producing resistor layers 3 are provided by forming a film of $TaSiO_2$ by CVD or sputtering. The electrode layers 4, which are laminated on the heat-producing resistor layers 3, are provided by forming a film of conductive metal such as A1 by sputtering.

The main heat-producing resistor sections 31, the auxiliary heat-producing resistor sections 32 and the first through the fourth electrodes 41-44 shown in FIG. 1 are formed by the method described below.

First, a plurality of heat-producing resistor layers 3 each in the form of a strip (having a width W, and a length including the main heat-producing resistor section 31 and the auxiliary heat-producing resistor section 32) are formed on the glaze layer 2 so as to extend in parallel with the secondary scanning direction Y and to be spaced from each other in the secondary scanning direction X at a predetermined pitch D1. Then, a plurality of U-shaped electrode layers 4 are formed. Each of the electrode layers includes two strip portions each of which has a width w and which extend in parallel with each other at a predetermined pitch D1 and a channel-shaped portion connecting respective upper ends of the two strip portions to each other. The electrode layers are so formed that the strip portions thereof overlap the strips of the heat-producing resistor layers 3.

Subsequently, portions of the electrode layers which correspond to the main heat-producing resistor sections 31 and the auxiliary heat-producing resistor sections 32 are selectively etched away by e.g. photolithography, whereby first through fourth electrodes 41-44 are provided.

As shown in FIG. 2, the auxiliary heat-producing resistor sections 32 and the main heat-producing resistor sections 31 are formed on the top surface 21*a* and an inclined surface 21*b* of the bulging portion 21, respectively. Therefore, the portions of the electrode layers 4 which are positioned on the top surface 21*a* and the inclined surface 21*b* are etched away.

The protective layer 5 is made of $Ta_2O_5$ or $Si_3N_4$, for example. The protective layer 5 is formed by CVD or sputtering, for example.

The main heat-producing resistor sections 31 on the inclined surface 21*b* of the glaze layer 2 are spaced from each other in the primary scanning direction X by the predetermined distance D1. The auxiliary heat-producing resistor sections 32 on the top surface 21*a* of the glaze layer 2 are positioned upstream from the main heat-producing sections 31 in the secondary scanning direction Y (in the direction in which recording paper is transferred in the printing process). The arrangement pitch of the auxiliary heat-producing resistor sections 32 in the primary scanning direction X is equal to the arrangement pitch D1 of the main heat-producing resistor sections 31.

As shown in FIG. 1, the main heat-producing resistor sections 31 are divided into a plurality of sets each consisting of two adjacent main heat-producing resistor sections. The two main heat-producing resistor sections 31 in each set are electrically connected to each other via a fourth electrode 44. The two main heat-producing sections 31 in each set are respectively connected electrically to two auxiliary heat-producing resistor sections 32 provided upstream from the main heat-producing sections in the secondary scanning direction Y by two third electrodes 43.

Now, in each set, let the left main heat-producing resistor section 31 be the first main heat-producing resistor section 31, the right main heat-producing resistor section 31 be the second main heat-producing resistor section 31, the left auxiliary heat-producing resistor section 32 be the first auxiliary heat-producing resistor section 32, and the right auxiliary heat-producing resistor section 32 be the second auxiliary heat-producing resistor section 32. Then, each set includes a series circuit consisting of the first and the second main heat-producing resistor sections 31 and the first and the second auxiliary heat-producing resistor sections 32.

In each set, to the first auxiliary heat-producing resistor section 32 and the second auxiliary heat-producing resistor section 32, one end of the second electrode 42 and one end of the first electrode 41 are electrically connected, respectively. The other end of the first electrode 41 is connected to a non-illustrated common electrode (ground electrode), whereas the other end of the second electrode 41 is connected to a non-illustrated driver IC.

The driver IC controls power supply to the series circuit consisting of the first and the second main heat-producing resistor sections 31 and the first and the second auxiliary heat-producing resistor sections 32 in each set, i.e., controls energization of the first and the second main heat-producing resistor sections 31 and the first and the second auxiliary heat-producing resistor sections 32.

In the above-described structure, the first and the second main heat-producing resistor sections 31 in each set operate as heating elements for printing one dot in the dot printing process. The first and the second auxiliary heat-producing resistor sections 32 in each set operate as heating elements for preliminarily heating thermal recording paper or the ink ribbon in the case where printing is to be performed by heating thermal recording paper or the ink ribbon by the first and the second main heat-producing resistor sections 92.

The printing operation by each set of the first and the second main heat-producing resistor sections 31 is controlled by the driver IC based on the bit data corresponding to that set.

The distance D2 (corresponding to the length of the third electrode 43) between the main heat-producing resistor section 31 and the auxiliary heat-producing resistor section 32 in the secondary scanning direction Y is larger than the length L1 of the main heat-producing resistor section 31 in the secondary scanning direction Y and not more than twice the length L1. That is, $L1<D2<2\cdot L2$ holds true.

The length L2 of the auxiliary heat-producing resistor section 32 in the secondary scanning direction Y is smaller than the length L1 of the main heat-producing resistor section 31. That is, $L2<L1$ holds true. The reason why the length L2 is set smaller is that, since the auxiliary heat-producing resistor section 32 is used for preliminary heating as noted above, the resistance of the auxiliary heat-producing resistor section 32 should be lower than that of the main heat-producing resistor section 31 so that the amount of heat produced by the auxiliary heat-producing resistor section 32 becomes smaller than that produced by the main heat-producing resistor section 31.

In the case of a resistor in the form of a strip, the resistance is proportional to the length when the width is the same. Therefore, by setting the length to satisfy $L2<L1$, the resistance of the auxiliary heat-producing portion 32 becomes lower than the resistance of the main heat-producing resistor section 31.

Specifically, for example, the length L1 may be 170 μm, the distance D2 may be 305 μm, and the length L2 may be 20 μm. As noted before, the width W of the main heat-producing resistor section 31 and the width W of the auxiliary heat-producing resistor section 32 in the primary scanning direction X are equal to each other.

The operation and advantages of the thermal printhead A1 will be described below.

As shown in FIG. 2, to perform printing, a platen roller P is set in pressure contact with portions of the protective layer 5 at locations corresponding to the main heat-producing resistor sections 31 and the auxiliary heat-producing resistor sections 32. In this state, recording paper S, which may be e.g. thermal recording paper, is supplied between the platen roller and the protective layer and transferred in the secondary scanning direction Y.

The platen roller P may be made of rubber, for example, and the portion thereof which is held in contact with the protective layer 5 is deformed due to the contact pressure. The recording paper S is preheated by the auxiliary heat-producing resistor section 32 at a temperature at which printing is not performed. The preheated portion is then transferred to the main heat-producing resistor section 31 and heated at a temperature higher than the preheating temperature, whereby printing on the recording paper S is performed.

As noted before, the distance D2 between the main heat-producing resistor section 31 and the auxiliary heat-producing resistor section 32 is longer than the length L1 of the main heat-producing resistor section 31. With such a structure, the heat production at the main heat-producing resistor section 31 and the heat production at the auxiliary heat-producing resistor section 32 do not influence each other. Therefore, even when the same main heat-producing resistor section 31 and the corresponding auxiliary heat-producing resistor section 32 are continuously energized for continuous heat production in order to print e.g. a line extending in parallel with the secondary scanning direction Y on the recording paper, the temperature at the auxiliary heat-producing resistor section 32 is prevented from becoming excessively higher than the predetermined preheating temperature due to the influence of the heat production at the main heat-producing resistor section 31.

Further, the temperature at the third electrodes 43 interposed between the main heat-producing resistor section 31 and the auxiliary heat-producing resistor section 32 is also prevented from becoming excessively higher than a predetermined temperature. Therefore, the recording paper is prevented from being colored due to the temperature rise at the auxiliary heat-producing section 32 or the third electrode 43 before the print position of the recording paper S is transferred to the main heat-producing resistor section 31.

The distance D2 is not more than twice the length L1 of the main heat-producing resistor section 31, as noted above. Therefore, the recording paper S is transferred to the main heat-producing resistor section 31 before the temperature at the portion preheated by the auxiliary heat-producing resistor section 32 drops considerably. Further, such a distance does not reduce the transfer speed of the recording paper S. Therefore, unlike the conventional thermal printhead, the print speed is not reduced.

In the thermal printhead A1, by changing the amount of the current (degree of energization) flowing through the main heat-producing resistor section 31, the amount of heat produced changes so that the area of one dot to be printed on the recording paper S changes. Preferably, the degree of energization is so controlled that only the center or the portion near the center of the main heat-producing resistor section 31 reaches a temperature at which printing on the recording paper S is performed. By such control, the number of gradations can be increased by performing so-called overlap printing, for example.

In some applications of the thermal printhead A1, it may be desired that the size of a print dot is generally equal to the area of the main heat-producing resistor section 31. In this case, the degree of energization of the main heat-producing resistor section 31 increases, and the heating temperature of the main heat-producing resistor section 31 increases, which causes concern for the thermal influence on the auxiliary heat-producing resistor section 32 as noted above.

In the thermal printhead A1 of this embodiment, however, the distance D2 is longer than the length L1 of the main heat-producing resistor section 31. Therefore, even when the heating of the main heat-producing resistor section 31 influences the auxiliary heat-producing resistor section 32 due to the increase in the degree of energization and the temperature at the auxiliary heat-producing resistor section 32 is raised to result in the coloring of the recording paper S, the portion of the recording paper S which is colored by the auxiliary heat-producing resistor section 32 is spaced from the print dot printed by the main heat-producing resistor section 31 by the distance greater than one dot.

Therefore, focusing attention on a single print dot, unlike the conventional thermal printhead B in which the portion corresponding to the auxiliary heat-producing section 93 and the electrode 96 is entirely colored, a space which is larger than a single dot is secured between a portion at which a dot is to be printed and a portion at which printing is not to be performed. Therefore, as compared with the printing using the conventional thermal printhead B, the clearness of the print dot is not degraded largely so that the deterioration of the print quality is prevented.

In the thermal printhead A1 according to the first embodiment, the width W of the main heat-producing resistor section 31 and that of the auxiliary heat-producing resistor section 32 in the primary scanning direction X are generally equal to each other. Therefore, as compared with the conventional thermal printhead B, the spacing between two main heat-producing resistor sections arranged adjacent to each other in the primary scanning direction X is relatively small. With such an arrangement, the width of the region where printing is not performed in the primary scanning direction X is reduced, which enhances the print quality.

Relative to the thermal printhead A1 according to the first embodiment, the platen roller P is arranged above the bulging portion 21 of the glaze layer 2 and at a position for strongly pressing the recording paper S against the portion corresponding to the main heat-producing resistor section 31 on the inclined surface 21*b* of the bulging portion 21. In the thermal printhead A1 of the first embodiment, the auxiliary heat-producing resistor section 32 is provided on the top surface 21*a* of the bulging portion 21 and positioned higher than the main heat-producing resistor section 31, so that the platen roller P can reliably and strongly press the recording paper S also against the portion on the auxiliary heat-producing resistor section 32.

When the recording paper S is supplied onto the bulging portion 21 obliquely from above, the recording paper S inevitably passes on the top surface 21*a* which is the highest part of the bulging portion 21. This also ensures the pressing of the recording paper S against the portion on the auxiliary heat-producing section 32, whereby the preheating of the recording paper S can be reliably performed.

The thermal printhead A1 according to the first embodiment is also applicable to printing on standard recording paper using an ink ribbon. In this case, since the distance D2 between the main heat-producing resistor section 31 and the auxiliary heat-producing resistor section 32 is longer than the length L1 of the main heat-producing resistor section 31, the ink ribbon is prevented from being rapidly heated or rapidly cooled. Therefore, the formation of wrinkles in the ink ribbon due to the expansion caused by rapid heating or the shrinkage caused by rapid cooling can be prevented.

Figure 3:
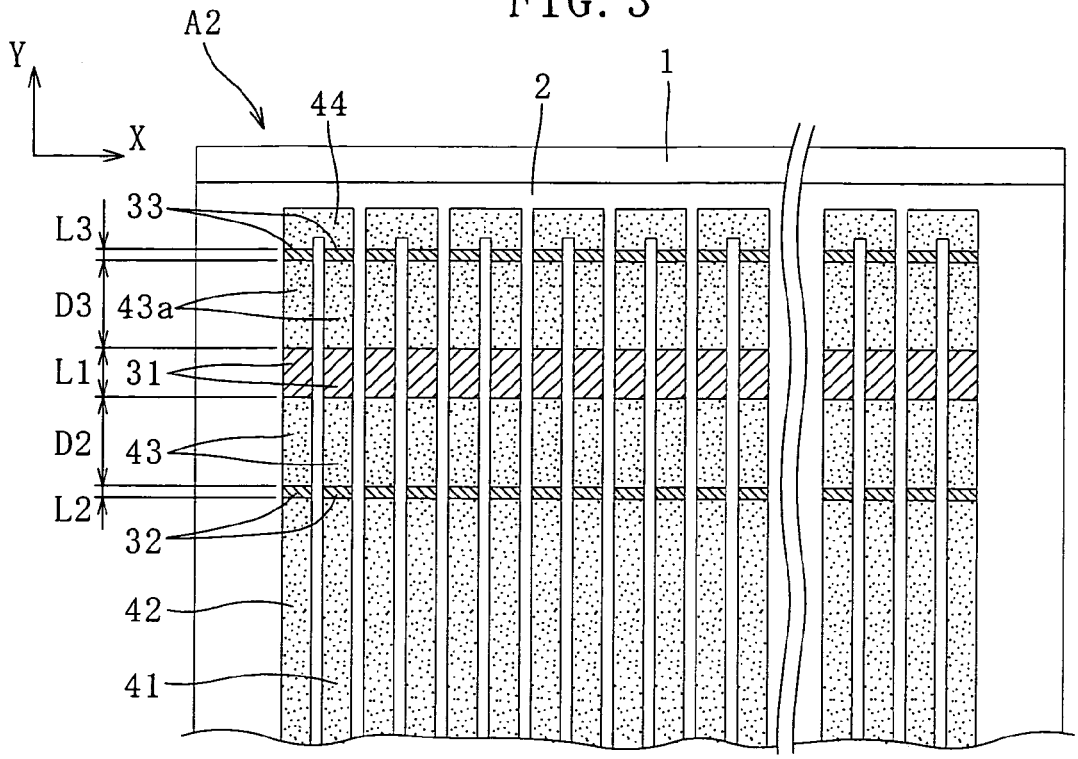
FIG. 3 is a plan view showing a principal portion of a thermal printhead according to a second embodiment of the present invention.
Figure 4:
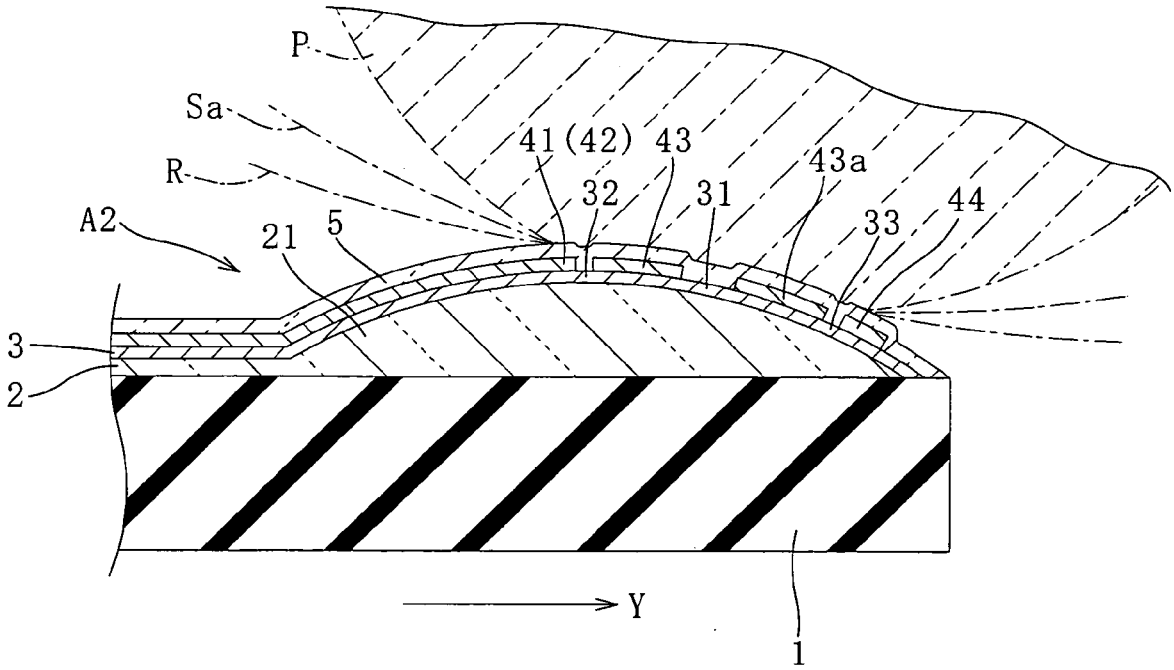
FIG. 4 is a sectional view of the principal portion of the thermal printhead shown in FIG. 3.

FIG. 3 is a plan view showing a principal portion of a thermal printhead according to a second embodiment of the present invention. FIG. 4 is a sectional view showing the principal portion of the thermal printhead in the process of performing printing on standard recording paper using an ink ribbon. In FIGS. 3 and 4, the elements which are identical or similar to those of the first embodiment are designated by the same reference signs as those used in the first embodiment. In FIG. 3, the protective layer 5 is omitted. In FIG. 3, the hatched portions indicate resistor layers 3, whereas the dotted portions indicate electrode layers 4.

The thermal printhead A2 shown in FIGS. 3 and 4 includes a plurality of electrodes 43*a* and a plurality of auxiliary heat-producing resistor sections 33 for post-heating on the downstream side of the main heat-producing resistor sections 31 in the secondary scanning direction Y. Thus, the thermal printhead A2 of the second embodiment has preheating function and post-heating function.

Two adjacent auxiliary heat-producing resistor sections 33 are paired with each other and electrically connected in series by a fourth electrode 44. Each pair of auxiliary heat-producing resistor sections 33 is electrically connected in series to two main heat-producing resistor sections 31 and two auxiliary heat-producing resistor sections 32 for preheating.

Similarly to the relationship between the auxiliary heat-producing resistor section 32 and the main heat-producing resistor section 31, the distance D3 between the auxiliary heat-producing resistor section 33 and the main heat-producing resistor section 31 in the secondary scanning direction Y is larger than the length L1 of main heat-producing resistor section 31 in the secondary scanning direction Y and not more than twice the length L1. For instance, the distance D3 is generally equal to the distance D2. The length L3 of the auxiliary heat-producing resistor section 33 in the secondary scanning direction Y is shorter than the length L1 and generally equal to the length L2, for example. The width of the auxiliary heat-producing resistor section 33 in the primary scanning direction X is generally equal to that of the main heat-producing resistor section 31 and that of the auxiliary heat-producing resistor section 32.

The thermal printhead A2 is suitable for printing on regular recording paper Sa by using an ink ribbon R. When a printhead does not have preheating and post-heating functions, the ink ribbon R in the process of being transferred along the main heat-producing resistor section 31 is rapidly heated by the main heat-producing section 31 and then rapidly cooled by the air, so that the heated portion of the ink ribbon R suddenly expands and then suddenly shrinks. Therefore, wrinkles are easily formed in the ink ribbon R having a small thickness, which hinders proper transfer of the ink to the recording paper Sa and may result in print failure.

However, in the thermal printhead A2 according to the second embodiment, the heating by the main heat-producing resistor section 31 is performed after the ink ribbon R is preheated by the auxiliary heat-producing resistor section 32. Therefore, the ink ribbon R is prevented from being rapidly heated. Moreover, since the ink ribbon R is subjected to post-heating by the auxiliary heat-producing resistor section 33, the rapid cooling of the ink ribbon R is also prevented. Therefore, the formation of wrinkles in the ink ribbon R is properly prevented.

Similarly to the distance D2, the distance D3 between the auxiliary heat-producing resistor section 33 and the main heat-producing resistor section 31 in the secondary scanning direction Y is larger than the length L1 of the main heat-producing resistor section 31. Therefore, the auxiliary heat-producing resistor section 33 is prevented from exceeding a predetermined temperature due to the thermal influence by the main heat-producing resistor section 31, and the electrode 43*a* interposed between the auxiliary heat-producing resistor section 33 and the main heat-producing resistor section 31 is prevented from exceeding a predetermined temperature. Thus, the same advantages as those of the auxiliary heat-producing resistor section 32 in the thermal printhead A1 of the first embodiment can be obtained.

The distance D3 is not more than twice the length L1 and is so set that the auxiliary heat-producing resistor section 33 is not too far away from the main heat-producing resistor section 31. Therefore, in the thermal printhead A2 according to the second embodiment, the post-heating can be reliably performed so that the portion of the ink ribbon R used for printing is not cooled rapidly. The structure of the auxiliary heat-producing resistor section 33, such as the length L3 in the secondary scanning direction Y and the width in the primary scanning direction X, is similar to that of the auxiliary heat-producing resistor section 32. Therefore, it is easy to make the heating temperature thereof lower than that of the main heat-producing resistor section 31 and to make the spacing between adjacent main heat-producing resistor sections 31 in the primary scanning direction X relatively small.

Figure 5:
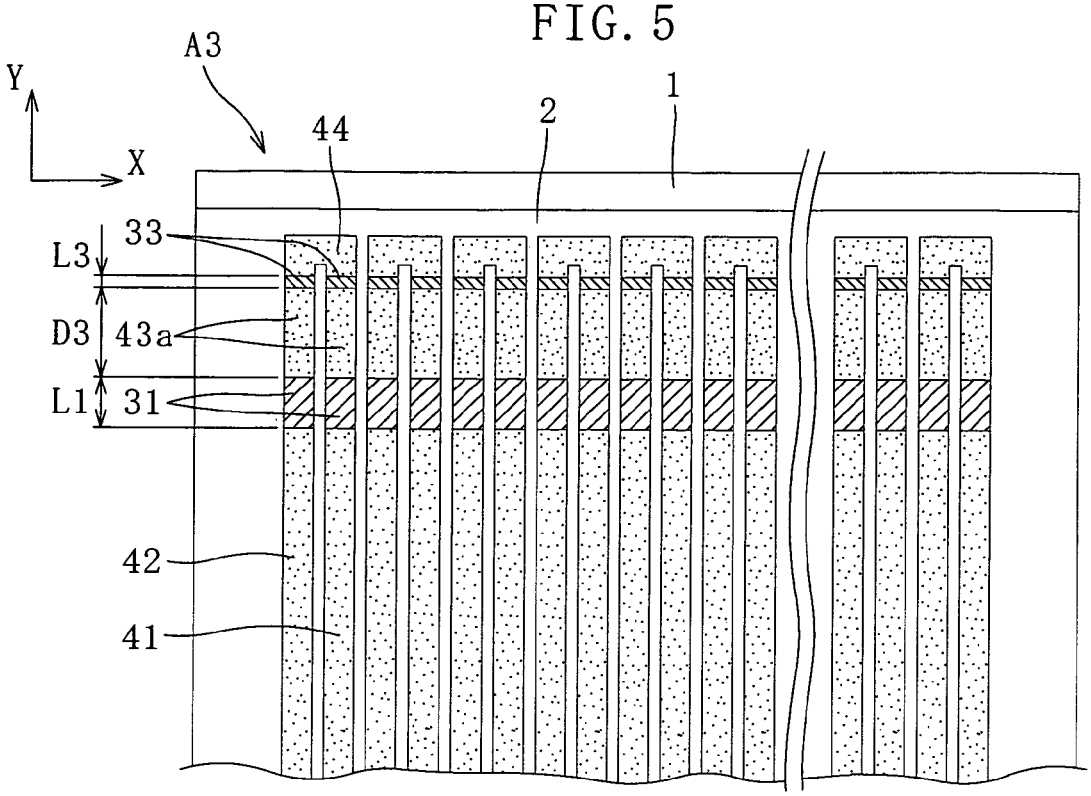
FIG. 5 is a plan view showing a principal portion of a thermal printhead according to a third embodiment of the present invention.
Figure 6:
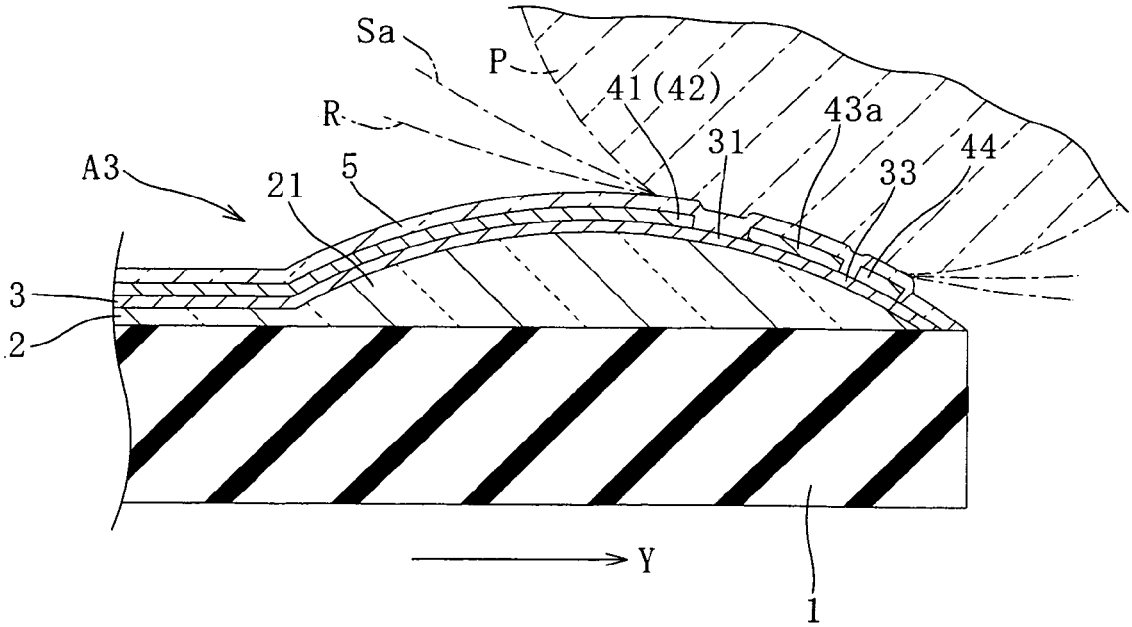
FIG. 6 is a sectional view of the principal portion of the thermal printhead shown in FIG. 5.

FIG. 5 is a plan view showing a principal portion of a thermal printhead according to a third embodiment of the present invention. FIG. 6 is a sectional view showing the principal portion of the thermal printhead in the process of performing printing on standard recording paper using an ink ribbon. In FIGS. 5 and 6, the elements which are identical or similar to those of the first embodiment are designated by the same reference signs as those used in the first embodiment. In FIG. 5, the protective layer 5 is omitted. In FIG. 5, the hatched portions indicate resistor layers 3, whereas the dotted portions indicate electrode layers 4.

The thermal printhead A3 of the third embodiment shown in FIG. 5 has a structure obtained by eliminating, from the thermal printhead A2 of the second embodiment shown in FIG. 3, the auxiliary heat-producing resistor portions 32 for preheating on the upstream side of the main heat-producing resistor sections 31 in the secondary scanning direction Y.

In the printing process using the thermal printhead A3 according to the third embodiment of the present invention, rapid cooling of the ink ribbon R is prevented by performing post-heating, although preheating of the ink ribbon R is not performed. Therefore, in this case again, the formation of wrinkles in the ink ribbon R is prevented.

Figure 7:
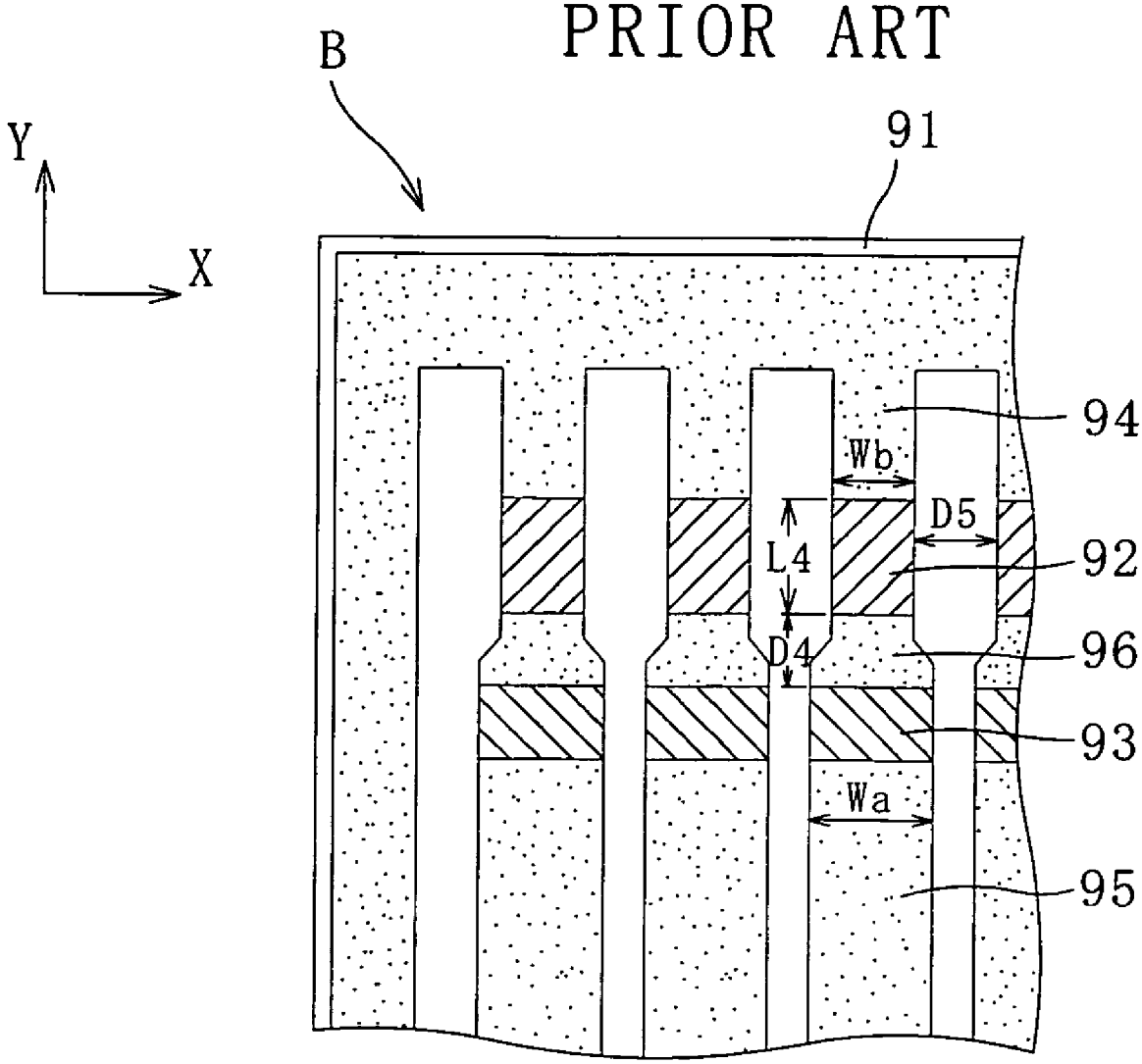
FIG. 7 PRIOR ART
FIG. 7 is a plan view showing a principal portion of a conventional thermal printhead.

In the foregoing embodiments, the main heat-producing resistor sections 31 arranged in the primary scanning direction X are divided into a plurality of sets each consisting of two adjacent main heat-producing resistor sections 31. The two main heat-producing resistor sections 31 in each set are connected in series to auxiliary heat-producing resistor sections 32 for preheating provided upstream from the main heat-producing resistor sections in the primary scanning direction Y or the auxiliary heat-producing resistor sections 32 for post-heating provided downstream from the main heat-producing resistor sections in the primary scanning direction Y or both of the auxiliary heat-producing resistor sections 32 and 33. However, similarly to the conventional thermal printhead B shown in FIG. 7, each of the main heat-producing resistor sections 31 may be connected in series to the auxiliary heat-producing resistor section 32 for preheating provided upstream from the main heat-producing resistor section in the primary scanning direction Y or the auxiliary heat-producing resistor section 32 for post-heating provided downstream from the main heat-producing resistor section in the primary scanning direction Y or both of the auxiliary heat-producing resistor sections 32 and 33.

The present invention is not limited to the foregoing embodiments. The specific structure of each part of the thermal printhead according to the present invention may be modified in various ways. The pattern of electrodes of the thermal printhead according to the present invention is not limited. The present invention is also applicable to a thermal printhead which includes a common electrode with so-called comb-tooth portions. Moreover, the present invention is applicable to both of a thick-film thermal printhead and a thin-film thermal printhead.

The invention claim is:

1. A thermal printhead comprising:

a plurality of main heat-producing resistor sections formed on a substrate and arranged at predetermined intervals in a primary scanning direction;

a plurality of auxiliary heat-producing resistor sections each of which is spaced from a respective one of the main heat-producing resistor sections by a predetermined distance in a secondary scanning direction which is perpendicular to the primary scanning direction;

a plurality of first electrodes each connecting, in series, at least one of the main heat-producing resistor sections and the corresponding auxiliary heat-producing resistor section which are, arranged in the secondary scanning direction;

a plurality of second electrodes for energizing the series circuits of the main heat-producing resistor sections and the auxiliary heat-producing resistor sections connected in series by the first electrodes, printing being performed by heating a printing recording medium by the main heat-producing resistor sections while transferring the printing recording medium in the secondary scanning direction; and a glaze layer including a bulging portion and formed on the substrate, the bulging portion including a top surface and an inclined surface, the inclined surface being positioned downstream from the top surface in the secondary scanning direction and gradually reducing height from the substrate while extending downstream in the secondary scanning direction;

wherein the distance between each of the main heat-producing resistor sections and a corresponding one of the auxiliary heat-producing resistor sections in the secondary scanning direction is larger than length of the main heat-producing resistor section in the secondary scanning direction;

wherein each of the auxiliary heat-producing resistor sections is positioned upstream from each of the main heat-producing resistor sections in the secondary scanning direction;

wherein each of the main heat-producing resistor sections is provided on the inclined surface of the bulging portion; and wherein each of the auxiliary heat-producing resistor sections is provided on the top surface or the inclined surface of the bulging portion at a position higher than each of the main heat-producing resistor sections.

2. The thermal printhead according to claim 1, wherein the distance between each of the main heat-producing resistor sections and a corresponding one of the auxiliary heat-producing resistor sections in the secondary scanning direction is not more than twice the length of the main heat-producing resistor section in the secondary scanning direction.

3. The thermal printhead according to claim 1, wherein each of the main heat-producing resistor sections and each of the auxiliary heat-producing resistor sections are generally equal to each other in width in the primary scanning direction.

4. The thermal printhead according to claim 3, wherein each of the auxiliary heat-producing resistor sections is smaller than each of the main heat-producing resistor sections in length in the secondary scanning direction.

5. The thermal printhead according to claim 1, wherein the plurality of main heat-producing resistor sections and the plurality of auxiliary heat-producing resistor sections are divided into a plurality of sets each including two main heat-producing resistor sections and two auxiliary heat-producing resistor sections arranged adjacent in the secondary scanning direction; and wherein the first electrode connects the two main heat-producing resistor sections and the two auxiliary heat-producing resistor sections in each of the sets in series.

6. A thermal printhead comprising:

a plurality of main heat-producing resistor sections formed on a substrate and arranged at predetermined intervals in a primary scanning direction;

a plurality of auxiliary heat-producing resistor sections each of which is spaced from a respective one of the main heat-producing resistor sections by a predetermined distance in a secondary scanning direction which is perpendicular to the primary scanning direction;

a plurality of first electrodes each connecting, in series, at least one of the main heat-producing resistor sections and the corresponding auxiliary heat-producing resistor section which are arranged in the secondary scanning direction;

a plurality of second electrodes for energizing the series circuits of the main heat-producing resistor sections and the auxiliary heat-producing resistor sections connected in series by the first electrodes, printing being performed by heating a printing recording medium by the main heat-producing resistor sections while transferring the printing recording medium in the secondary scanning direction; and a glaze layer including a bulging portion and formed on the substrate, the bulging portion including a top surface and an inclined surface, the inclined surface being positioned downstream from the top surface in the secondary scanning direction and gradually reducing height from the substrate while extending downstream in the secondary scanning direction;

wherein the distance between each of the main heat-producing resistor sections and a corresponding one of the auxiliary heat-producing resistor sections in the secondary scanning direction is larger than length of the main heat-producing resistor section in the secondary scanning direction;

wherein each of the auxiliary heat-producing resistor sections is positioned downstream from each of the main heat-producing resistor sections in the secondary scanning direction;

wherein each of the main heat-producing resistor sections is provided on the inclined surface of the bulging portion; and wherein each of the auxiliary heat-producing resistor sections is provided on the top surface or the inclined surface of the bulging portion at a position higher than each of the auxiliary heat-producing resistor sections.

7. A thermal printhead comprising:

a plurality of main heat-producing resistor sections formed on a substrate and arranged at predetermined intervals in a primary scanning direction;

a plurality of auxiliary heat-producing resistor sections each of which is spaced from a respective one of the main heat-producing resistor sections by a predetermined distance in a secondary scanning direction which is perpendicular to the primary scanning direction;

a plurality of first electrodes each connecting, in series, at least one of the main heat-producing resistor sections and the corresponding auxiliary heat-producing resistor section which are arranged in the secondary scanning direction;

a plurality of second electrodes for energizing the series circuits of the main heat-producing resistor sections and the auxiliary heat-producing resistor sections connected in series by the first electrodes, printing being performed by heating a printing recording medium by the main heat-producing resistor sections while transferring the printing recording medium in the secondary scanning direction; and a glaze layer including a bulging portion and formed on the substrate, the bulging portion including a top surface and an inclined surface, the inclined surface being positioned downstream from the top surface in the secondary scanning direction and gradually reducing height from the substrate while extending downstream in the secondary scanning direction;

wherein the distance between each of the main heat-producing resistor sections and a corresponding one of the auxiliary heat-producing resistor sections in the secondary scanning direction is larger than length of the main heat-producing resistor section in the secondary scanning direction;

wherein the plurality of auxiliary heat-producing resistor sections include a first auxiliary heat-producing resistor section for preheating provided upstream from the main heat-producing resistor sections in the secondary scanning direction and a second auxiliary heat-producing resistor section for post-heating provided downstream from the main heat-producing resistor sections in the secondary scanning direction;

wherein each of the main heat-producing resistor sections is provided on the inclined surface of the bulging portion;

wherein each of the first auxiliary heat-producing resistor sections is provided on the top, surface or the inclined surface of the bulging portion at a position higher than each of the main heat-producing resistor sections; and wherein each of the second auxiliary heat-producing resistor sections is provided on the inclined surface of the bulging portion at a position lower than each of the main heat-producing resistor sections.

* * * * *